United States Patent [19]

Watts et al.

[11] Patent Number: 4,956,122

[45] Date of Patent: Sep. 11, 1990

[54] LUBRICATING COMPOSITION

[75] Inventors: Raymond F. Watts, Califon, N.J.; Frederick C. Loveless, Cheshire; Walter Nudenberg, Newtown, both of Conn.

[73] Assignee: Uniroyal Chemical Company, Inc., Middlebury, Conn.

[21] Appl. No.: 291,382

[22] Filed: Dec. 23, 1988

Related U.S. Application Data

[63] Continuation of Ser. No. 58,486, Jun. 5, 1987, abandoned, which is a continuation of Ser. No. 901,103, Aug. 28, 1986, abandoned, which is a continuation of Ser. No. 782,233, Sep. 30, 1985, abandoned, which is a continuation of Ser. No. 649,258, Sep. 10, 1984, abandoned, which is a continuation-in-part of Ser. No. 473,841, Mar. 9, 1983, abandoned, which is a continuation-in-part of Ser. No. 356,665, Mar. 10, 1982, abandoned.

[51] Int. Cl.[5] ..... C10M 107/10

[52] U.S. Cl. ..... 252/565; 585/11; 585/12

[58] Field of Search ..... 252/565; 585/11, 12

[56] References Cited

U.S. PATENT DOCUMENTS

| | | | |
|---|---|---|---|
| 2,551,643 | 5/1951 | Seger et al. | 252/565 X |
| 3,053,768 | 9/1962 | Cupper | 252/565 X |
| 3,763,244 | 10/1973 | Shubkin | 252/565 X |
| 3,780,128 | 12/1973 | Shubkin | 252/565 X |
| 3,808,134 | 4/1974 | Romine | 585/11 |
| 4,036,771 | 7/1977 | Denis et al. | 252/565 X |
| 4,060,492 | 10/1977 | Yasui et al. | 585/275 X |
| 4,172,855 | 10/1979 | Shubkin et al. | 252/565 X |
| 4,218,330 | 8/1980 | Shubkin | 252/565 X |

FOREIGN PATENT DOCUMENTS

| | | |
|---|---|---|
| 1208968 | 10/1970 | United Kingdom . |
| 1246880 | 9/1971 | United Kingdom . |
| 1264981 | 2/1972 | United Kingdom . |
| 1287579 | 8/1972 | United Kingdom . |
| 1455893 | 11/1976 | United Kingdom . |

OTHER PUBLICATIONS

Wills, *Lubrication Fundamentals*, 1980, pp. 75–87, pub. by Marcel Dekker, Inc.

Miller et al., "Synthetic Engine Oils–A New Concept", Automotive Engineering Congress of SAE, Detroit, Mich., 2/25–3/1/1974, pp. 1–19.

Manley et al., "New Developments in Synthetic Lubricants", paper presented at the Tenth World Petroleum Congress, 9/14/79, pp. 1–9.

Larsen et al., "Functional Selection of Synthetic Lubricants", Ind. & Eng. Chem., vol. 42, No. 12, pp. 2421–2427.

Watts et al., "Newtonian Multigrade Gear Lubricants": Formulation and Performance Testing, SAE paper 821/80, pp. 1–12, presented at Fuels & Lubricant Meeting, Toronto, Ontario, Canada 10/18–21/1982.

*Primary Examiner*—Patrick P. Garvin

*Attorney, Agent, or Firm*—John A. Shedden

[57] ABSTRACT

A lubricating composition is provided containing: a high viscosity synthetic hydrocarbon such as high viscosity polyalphaolefins, liquid hydrogenated polyisoprenes or ethylene-alphaolefin copolymers having a viscosity of 40–1000 centistokes at 100° C.; a low viscosity synthetic hydrocarbon and/or optionally a low viscosity ester; and optionally an additive package to impart desirable performance properties to the composition.

10 Claims, No Drawings

LUBRICATING COMPOSITION

This application is a continuation of Ser. No. 058,486 filed June 5, 1987 which is a continuation of Ser. No. 901,103 filed Aug. 28, 1986 which is a continuation of Ser. No. 782,233 filed Sept. 30, 1985 which is a continuation of Ser. No. 649,258 filed Sept. 10, 1984 which is a continuation-in-part of Ser. No. 473,841 filed Mar. 9, 1983, which is a continuation-in-part of Ser. No. 356,665 filed Mar. 10, 1982, all of which are now abandoned.

This invention relates to compositions useful as lubricating oils having high viscosity index, improved resistance to oxidative degradation and resistance to viscosity losses caused by permanent or temporary shear.

According to the instant invention a lubricating composition is provided comprising (1) a high viscosity synthetic hydrocarbon such as high viscosity polyalphaolefins, liquid hydrogenated polyisoprenes or ethylene-alphaolefin oligomers; (2) a low viscosity mineral oil or synthetic hydrocarbon, such as alkylated benzene or low viscosity polyalphaolefin; and/or, optionally, (3) a low viscosity ester, such as monoesters, diesters, polyesters and optionally (4) an additive package.

A further object of the invention is to provide lubricating compositions exhibiting permanent shear stability, superior oxidative stability and excellent temperature-viscosity properties.

A further object of the invention is to provide a lubricating composition with properties not obtainable with conventional polymeric thickeners.

The viscosity-temperature relationship of a lubricating oil is one of the critical criteria which must be considered when selecting a lubricant for a particular application. The mineral oils commonly used as a base for single and multigraded lubricants exhibit a relatively large change in viscosity with a change in temperature. Fluids exhibiting such a relatively large change in viscosity with temperature are said to have a low viscosity index. The viscosity index of a common paraffinic mineral oil is usually given a value of about 100. Viscosity index (VI) is determined according to ASTM Method D 2770-74 wherein the VI is related to kinematic viscosities measured at 40° C. and 100° C.

Lubricating oils composed mainly of mineral oil are said to be single graded. SAE grading requires that oils have a certain minimum viscosity at high temperatures and, to be multigraded, a certain maximum viscosity at low temperatures. For instance, an oil having a viscosity of 10 cSt. at 100° C. (hereinafter all viscosities are at 100° C. unless otherwise noted) would be an SAE 30 and if that oil had a viscosity of 3400 cP. at −20° C., the oil would be graded 10W-30. An unmodified mineral oil of 10 cSt. can not meet the low temperature requirements for a 10W-30 multigrade rating, since its viscosity index dictates that it would have a viscosity considerably greater than 3500 cP. at −20° C., which is the maximum allowed viscosity for a 10W rating.

The viscosity requirements for qualification as multigrade engine oils are described by the SAE Engine Oil Viscosity Classification-SAE J300 SEP80, which became effective Apr. 1, 1982. The low temperature (W) viscosity requirements are determined by ASTM D 2602, Method of Test for Apparent Viscosity of Motor Oils at Low Temperature Using the Cold Cranking Simulator, and the results are reported in centipoise (cP). The higher temperature (100° C.) viscosity is measured according to ASTM D445, Method of Test for Kinematic Viscosity of Transparent and Opaque Liquids, and the results are reported in centistokes (cSt). The following table outlines the high and low temperature requirements for the recognized SAE grades for engine oils.

| SAE Viscosity Grade | Viscosity (cP) at Temperature (°C.) Max. | Viscosity (cSt.) at 100° C. Min. | Max. |
|---|---|---|---|
| 0 W | 3250 at −30 | 3.8 | |
| 5 W | 3500 at −25 | 3.8 | |
| 10 W | 3500 at −20 | 4.1 | |
| 15 W | 3500 at −15 | 5.6 | |
| 20 W | 4500 at −10 | 5.6 | |
| 25 W | 6000 at −5 | 9.3 | |
| 20 | | 5.6 | Less that 9.3 |
| 30 | | 9.3 | Less that 12.5 |
| 40 | | 12.5 | Less that 16.3 |
| 50 | | 16.3 | Less that 21.9 |

In a similar manner, SAE J306c describes the viscometric qualifications for axle and manual transmission lubricants. High temperature (100° C.) viscosity measurements are performed according to ASTM D445. The low temperature viscosity values are determined according to ASTM D2983, Method of Test for Apparent Viscosity at Low Temperature Using the Brookfield Viscometer and these results are reported in centipoise (cP), where (cP) and (cSt) are related as follows:

$$cSt = \frac{cP}{\text{Density, k/dm}^3}$$

The following table summarizes the high and low temperature requirements for qualification of axle and manual transmission lubricants.

| SAE Viscosity Grade | Maximum Temperature for Viscosity of 150,000 cP. °C. | Viscosity at 100° C., cSt. Minimum | Maximum |
|---|---|---|---|
| 70 W | −55 | — | |
| 75 W | −40 | 4.1 | |
| 80 W | −26 | 7.0 | |
| 85 W | −12 | 11.0 | |
| 90 | — | 13.5 | 24.0 |
| 140 | — | 24.0 | 41.0 |
| 250 | — | | |

It is obvious from these tables that the viscosity index of a broadly multigraded oil such as 5W-40 or 70W-140 will require fluids having considerably higher viscosity index than narrowly multigraded lubricants such as 10W-30. The viscosity index requirements for different multigraded fluids can be approximated by the use of ASTM Standard Viscosity-Temperature Charts for Liquid Petroleum Products (D 341).

If one assumes the extrapolation of the high temperature (40° C. and 100° C.) viscosities to −40° C. or below is linear on chart D 341, then a line connecting a 100° C. viscosity of, for example, 12.5 cSt. and a low temperature viscosity of 3500 cP at −25° C. would give the correct 40° C. viscosity and permit an approximation of the minimum viscosity index required for that particular grade of oil (10W-40).

The 40° C. viscosity estimated by linearly connecting the 100° C. and −25° C. viscosities would be about 70 cSt. The viscosity index of an oil having $K.V._{100}=12.5$ cSt. and $K.V._{40}=70$ cSt. would be about 180 (ASTM D 2270-74). Unless the −25° C. viscosity of a fluid is lower than the linear relationship illustrated, then an oil must have a viscosity index of at least 180 to even potentially qualify as a 10W-40 oil.

In actual fact, many V.I. improved oils have viscosities at −25° C. which are considerably greater than predicted by linear extrapolation of the $K.V._{100}$ and $K.V._{40}$ values. Therefore, even having a V.I. of 180 does not guarantee the blend would be a 5W-40 oil.

Using this technique minimum viscosity index requirements for various grades of crankcase or gear oils can be estimated. A few typical estimations are shown in the following table:

| | $K.V._{100°\ C.}$ cSt. | Estimated $K.V._{40°\ C.}$ cSt. | Required Viscosity Index |
|---|---|---|---|
| Crankcase Oil Grade | | | |
| 10 W-30 | 9.3 | 60 | 135 |
| 5 W-40 | 12.5 | 70 | 180 |
| 5 W-30 | 9.3 | 53 | 159 |
| 0 W-50 | 16.3 | 75.5 | 232 |
| Gear Oil Grade | | | |
| 80 W-140 | 24 | 270 | 112 |
| 75 W-140 | 24 | 200 | 149 |
| 75 W-250 | 41 | 318 | 184 |
| 70 W-140 | 24 | 150 | 192 |

It can thus be seen that preparation of very broadly graded lubricants, such as 5W-40 or 75W-250 requires thickeners which produce very high viscosity indices in the final blends.

It has been the practice to improve the viscosity index of mineral oils or low viscosity synthetic oils by adding a polymeric thickener to relatively non-viscous base fluids. Polymeric thickeners are commonly used in the production of multigrade lubricants. Typical polymers used as thickeners include hydrogenated styrene-isoprene block copolymers, rubbers based on ethylene and propylene (OCP), polymers produced by polymerizing high molecular weight esters of the acrylate series, polyisobutylene and the like. These polymeric thickeners are added to bring the viscosity of a base fluid up to that required for a certain SAE grade and to increase the viscosity of index of the fluid, allowing the production of multigraded oils. Polymeric VI improvers are traditionally high molecular weight rubbers whose molecular weights may vary from 10,000 to 1,000,000. Since the thickening power and VI increase are related to the molecular weight of the VI improver, most of these polymers normally have a molecular weight of at least 100,000.

The use of these high molecular weight VI improvers, in the production of multigraded lubricants has some serious drawbacks:

1. They are very sensitive to oxidation, which results in a loss of VI and thickening power and frequently in the formation of unwanted deposits.

2. They are sensitive to large viscosity losses from mechanical shear when exposed to the high shear rates and stresses encountered in crankcases or gears.

3. They are susceptible to a high degree of temporary shear.

Temporary shear is the result of the non-Newtonian viscometrics associated with solutions of high molecular weight polymers. It is caused by an alignment of the polymer chains with the shear field under high shear rates with a resultant decrease in viscosity. The decrease viscosity reduces the wear protection associated with viscous oils. Newtonian fluids maintain their viscosity regardless of shear rate.

We have found that certain combination of fluids and additives can be used to prepare multigraded lubricants which outperform prior art formulations and have none or a greatly decreased amount of the above listed deficiencies found in polymerically thickened oils.

Certain specific blends of high viscosity synthetic hydrocarbons, low viscosity mineral oils or synthetic hydrocarbons and optionally low viscosity esters form base fluids from which superior crankcase or gear oils can be produced by the addition of the proper additive "packages". The finished oils thus prepare exhibit very high stability to permanent shear and, because of their Newtonian nature, very little, if any, temporary shear and so maintan the viscosity required for proper wear protection. The oils of this invention have remarkably better stability toward oxidative degradation than those of the prior art. The unexpectedly high viscosity indices produced from our base fluid blends permit the preparation of broadly multigraded crankcase fluids, such as 5W-40 and gear oils such as 75W-140. Up to now it has been difficult if not impossible, to prepare such lubricants without the use of frequently harmful amounts of polymeric VI improvers. In the instant invention, the high viscosity synthetic hydrocarbons having viscosities of 40 to 1000 cSt. may be polyalphaolefins, ethylene-alphaolefin oligomers or hydrogenated polyisoprene oligomers.

The high viscosity polyalphaolefins of the present invention, have viscosities of from 40 to 1000 cSt., preferably from 40 to 250 cSt., and are conveniently prepared by any of a series of methods described in the literature. The catalysts employed are those commonly referred to as Friedel-Crafts catalysts. Such catalysts cause cationic oligomerization of alphaolefins, such as octene-1 or decene-1 to molecular weights ranging up to several thousand, depending on the catalyst and polymerization conditions employed. While a variety of Friedel-Crafts catalysts can be used to prepare alphaolefin oligomers, it is common to use catalysts based on aluminum halides for the production of the moderately high molecular weight oils useful in the present invention. Descriptions of such catalysts can be found in U.S. Pat. No. 3,637,503 to Gulf Research and Development Company, U.S. Pat. No. 4,041,098 to Uniroyal, Inc. and U.S. Pat. No. 3,312,748 to Esso Research and Engineering Co.

Ziegler catalysts, such as described in U.S. Pat. No. 3,179,711 to Sun Oil Company can also be used to prepare oligomers in the molecular weight range useful in this invention.

Polyalphaolefins can likewise be prepared with peroxide catalysts, $BF_3$ based catalysts and by thermal polymerization. These methods, however, generally produce only low molecular weight oligomers.

The high molecular weight polyalphaolefins of this invention are preferably hydrogenated to decrease their level of unsaturation and thereby to increase their stability toward oxidation.

The alphaolefins utilized to make the high viscosity oligomers of the invention can range from $C_3$ (propylene) to $C_{14}$ (tetradecene) or any mixtures, although oligomers of octene-1, decene-1 and dodecene-1 are preferred because of their high viscosity indices and low pour points.

The high viscosity ethylene-alphaolefin oligomers of this invention are conveniently prepared by Ziegler catalysis. Many references exist covering methods of producing liquid oligomers of ethylene and alphaolefins (particularly propylene). Polymerization is typically performed by subjecting the monomer mixture usually in a solvent to the combination of an organo aluminum compound and a vanadium or titanium compound resulting in "vanadium catalyzed" or "titanium catalyzed" polymers respectively. The products formed can range from materials having viscosities as low as 20 cSt. to rubbery molecular weight regulating species, temperature of polymerization and, especially, imposed hydrogen pressure. In some instances low viscosity oligomers are prepared by the pyrolysis of high viscosity oligomers or rubbery solids. Typical preparations of liquid ethylene-alphaolefin copolymers can be found in references, such as:

U.S. Pat. No. 3,634,249 to Esso Research and Engineering Co.; U.S. Pat. No. 3,923,919 to Sun Ventures, Inc.,; U.S. Pat. No. 3,851,011 to Sun Research and Development Co.; U.S. Pat. No. 3,737,477 to Sun Oil Company; U.S. Pat. No. 3,499,741 to Texaco, Inc.; U.S. Pat. No. 3,681,302 to Texaco, Inc.; U.S. Pat. No. 3,819,592 to Uniroyal, Inc.; U.S. Pat. No. 3,896,094 to Uniroyal, Inc.; U.S. Pat. No. 3,676,521 to Uniroyal, Inc.; Belgian Patent No. 570,843; U.S. Pat. No. 3,068,306, and U.S. Pat. No. 3,328,366.

While oligomers of ethylene and at least one other alphaolefin of this invention may be hydrogenated to increase their stability toward oxidation, the proper choice of polymerization catalysts in the presence of hydrogen often produces oligomers having very low levels of unsaturation directly. The alphaolefins which can be used singly or in combinations with ethylene include linear alphaolefins of $C_3$ (propylene) to $C_{14}$ (tetradecene) and branches alphaolefins of the same molecular weight range, provided that the branch point is at least in the beta position to the double bond (e.g. 4-methyl pentene-1). Inasmuch as the rate of polymerization of such olefins relative to ethylene decreases with monomer size, propylene and the lower molecular weight olefins are the preferred monomers in the preparation of the oligomers of ethylene and at least one other alphaolefin of this invention.

It is also possible to use in this invention oligomeric ethylene-alpha olefin polymers which contain controlled amounts of unsaturation introduced by copolymerization with at least one copolymerizable polyene, especially a diene, particulary a non-conjugated diene, whether an open-chain diolefin such as 1,4-hexadiene or a cyclic diene such as dicyclopentadiene, bicyclononadiene, the alkylidene norbornenes (e.g., 5-methylene-2-norbornene, 5-ethylidene-2-norbornene, 5-propylidene-2-norbornene), etc. Preferred terpolymers contain from about 1 to about 25% (more preferably about 2 to about 25%) by weight of a non-conjugated diene such as dicyclopentadiene or the like. The introduction of unsaturation is sometimes desired if the oligomer is to be treated in any way to produce polar functionality thus giving the oligomer dispersant properties.

The viscosity of the ethylene-alphaolefin oligomers of this invention is preferably 40 to 1000 cSt. while the ethylene content is preferably 30 to 70 wt.%.

The oligomeric polyisoprenes of this invention may be prepared by Ziegler or, preferably, anionic polymerization. Such polymerization techniques are described in U.S. Pat. No. 4,060,492.

For the purposes of this invention, the preferred method of preparation for the liquid hydrogenation polyisoprenes is by the anionic alkyl lithium catalyzed polymerization of isoprene. Many references are available to those familiar with this art which describe the use of such catalysts and procedures. The use of alkyl lithium catalysts such as secondary butyl lithium results in a polyisoprene oligomer having a very high (usually greater than 80%) 1,4-content, which results in backbone unsaturation.

When alkyl lithium catalysts are modified by the addition of ethers or amines, a controlled amount of 1,2- and 3,4-addition can take place in the polymerization.

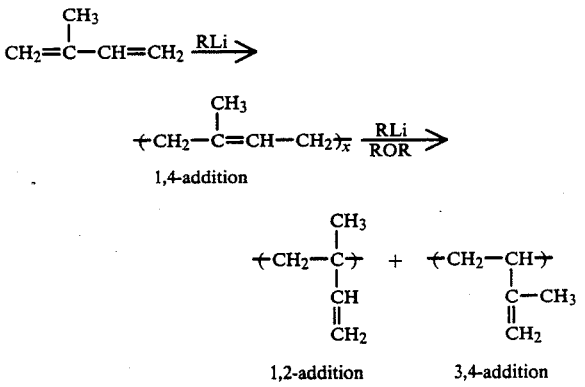

Hydrogenation of these structures gives rise to the saturated species represented below:

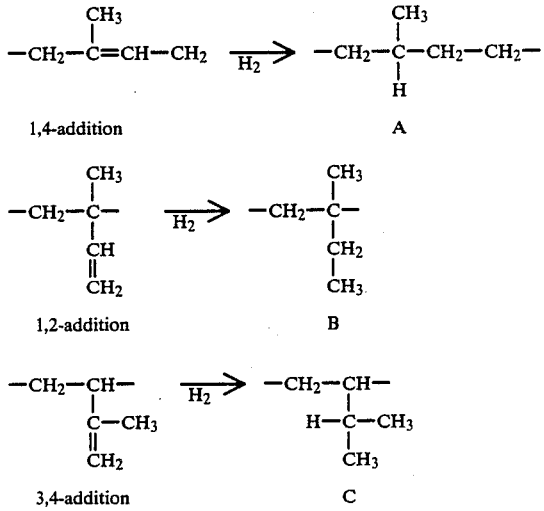

Structure A is the preferred structure because of its low Tg and because it has a lower percent of its mass in the pendant groups ($CH_3$-). Structure B is deficient in that the tetrasubstituted carbons produced serve as points of thermal instability. Structure C has 60% of its mass in a pendant (isopropyl) group which, if repeated decreases the thickening power of the oligomer for a given molecular weight and also raises the Tg of the resultant polymer. This latter property has been shown to correlate with viscosity index. Optimization of structure A is desired for the best combination of thickening power, stability and V.I. improvement properties.

Another feature of alkyl lithium polymers is the ease with which molecular weight and molecular weight distribution can be controlled. The molecular weight is a direct function of the monomer to catalyst ratio and, taking the proper precautions to exclude impurities, can be controlled very accurately thus assuring good quality control in the production of such polymer. The alkyl lithium catalysts produce very narrow molecular weight distributions such that Mw/Mn ratios of 1.1 are easily gained. For V.I. improvers a narrow molecular weight distribution is highly desirable since, at the given molecular weight, thickening power is maximized while oxidative and shear instability are minimized. If desired, broad or even polymodal M.W. distributions are easily produced by a variety of techniques well known in the art. Star-shaped or branched polymers can also be readily prepared by the inclusion of multifunctional monomers such as divinyl benzene or by termination of the "living" chains with a polyfunctional coupling agent such as dimethylterephthalate.

It is well known that highly unsaturated polymers are considerably less stable than saturated polymers toward oxidation. It is important, therefore, that the amount of unsaturation present in the polyisoprenes be drastically reduced. This is accomplished easily by anyone skilled in the art using, for instance, a Pt, Pd or Ni catalyst in a pressurized hydrogen atmosphere at elevated temperature.

Regardless of the mode of preparation, isoprene oligomers require hydrogenation to reduce the high level of unsaturation present after polymerization. For optimum oxidation stability, 90%, and preferably 99% or more of the olefinic linkages should be saturated.

To insure good oxidative and shear stability the high viscosity synthetic hydrocarbons of this invention should have viscosities ranging from about 40 cSt. to about 1000 cSt.

The low viscosity mineral oils which can be employed as base material in the lubricating compositions of this invention, may be paraffin base, naphthene base or mixed paraffin base distillate or residual oils. Paraffin base distillate lubricating oil fractions are used in the formulation of premium grade motor oil such as contemplated in this invention.

The low viscisity synthetic hydrocarbons of the present invention, having viscosities of from 1 to 10 cSt., consists primarily of oligomers of alphaolefins and alkylated benzenes.

Low molecular weight oligomers of alphaolefins from $C_8$ (octene) to $C_{12}$ (dodecene) or mixtures of the olefins can be utilized. Low viscosity alphaolefin oligomers can be produced by Ziegler catalysis, thermal polymerization, free radically catalyzed polymerization and, preferably, $BF_3$ catalyzed polymerization. A host of similar processes involving $BF_3$ in conjunction with a cocatalyst is known in the patent literature. A typical polymerization technique is described in U.S. Pat. No. 4,045,508.

The alkyl benzenes may be used in the present invention alone or in conjunction with low viscosity polyalphaolefins in blends with high viscosity synthetic hydrocarbons and low viscosity esters. The alkyl benzenes, prepared by Friedel-Crafts alkylation of benzene with olefins are usually predominantly dialkyl benzenes wherein the alkyl chain may be 6 to 14 carbon atoms long. The alkylating olefins used in the preparation of alkyl benzenes can be straight or branched chain olefins or combinations. These materials may be prepared as shown in U.S. Pat. No. 3,909,432.

The low viscosity esters of this invention, having viscosities of from 1 to 10 cSt. can be selected from classes of esters readily available commercially, e.g., monoesters prepared from monobasic acids such as pelargonic acid and alcohols; diesters prepared from dibasic acids and alcohols or from diols and monobasic acids or mixtures of acids; and polyol esters prepared from diols, triols (especially trimethylol propane), tetraols (such as pentaerythritol), hexaols (such as dipentaerythritol) and the like reacted with monobasic acids or mixtures of acids.

Examples of such esters include tridecyl pelargonate, di-2 ethylhexyl adipate, di-2 ethylhexyl azelate, trimethylol propane triheptanoate and pentaerythritol tetraheptanoate.

An alternative to the synthetically produced esters described above are those esters and mixtures of esters derived from natural sources, plant or animal. Examples of these materials are the fluids produced from jojoba nuts, tallows, safflowers and sperm whales.

The esters used in our blends must be carefully selected to insure compatibility of all components in finished lubricants of this invention. If esters having a high degree of polarity (roughly indicated by oxygen content) are blended with certain combinations of high viscosity synthetic hydrocarbon and low viscosity synthetic hydrocarbons, phase separation can occur at low temperatures with a resultant increase in apparent viscosity. Such phase separation is, of course, incompatible with long term storage of lubricants under a variety of temperature conditions.

The "additive package" to be mixed with the recommended base oil blend for the production of multigraded crankcase fluids or gear oils is usually a combination of various types of chemical additives so chosen to operate best under the use conditions which the particular formulated fluid may encounter.

Additives can be classified as materials which either impart or enhance a desirable property of the base lubricant blend into which they are incorporated. While the general nature of the additives might be the same for various types or blends of the base lubricants, the specific additives chosen will depend on the particular type of service in which the lubrican is employed and the characteristics of the base lubricants.

The main types of current day additives are:

1. Dispersants,
2. Oxidation and Corrosion Inhibitors,
3. Anti-Wear Agents,
4. Viscosity Improvers,
5. Pour Point Depressants,
6. Anti-Rust Compounds, and
7. Foam Inhibitors.

Normally a finished lubricant will contain several and possibly most or all of the above types of additives in what is commonly called an "additive package." The development of a balanced additive package involves considerably more work than the casual use of each of the additive types. Quite often functional difficulties arising from combinations of these materials show up under actual operating conditions. On the other hand, certain unpredictable synergistic effects of a desirable nature may also become evident. The only methods currently available for obtaining such data are from extensive full scale testing both in the laboratory and in the field. Such testing is costly and time-consuming.

Dispersants have been described in the literature as "detergents". Since their function appears to be one of effecting a dispersion of particulate matter, rather than one of "cleaning up" any existing dirt and debris, it is more appropriate to categorize them as dispersants. Materials of this type are generally molecules having a large hydrocarbon "tail" and a polar group head. The tail section, an oleophilic group, serves as a solubilizer in the base fluid while the polar group serves as the element which is attracted to particulate contaminants in the lubricant.

The dispersants include metallic and ashless types. The metallic dispersants include sulfonates (products of the neutralization of a sulfonic acid with a metallic base), thiophosphonates (acidic components derived from the reaction between polybutene and phosphous pentasulfide) and phenates and phenol sulfide salts (the broad class of metal phenates include the salts of alkylphenols, alkylphenol sulfides, and alkyl phenol aldehyde products). The ashless type dispersants may be categorized into two broad types: high molecular weight polymeric dispersants for the formulation of multigrade oils and lower molecular weight additives for use where viscosity improvement is not necessary. The compounds useful for this purpose are again characterized by a "polar" group attached to a relatively high molecular weight hydrocarbon chain. The "polar" group generally contains one or more of the elements—nitrogen, oxygen, and phosphorus. The solubilizing chains are generally higher in molecular weight than those employed in the metallic types; however, in some instances they may be quite similar. Some examples are N-substituted long chain alkenyl succinimides, high molecular weight esters, such as products formed by the esterification of mono or polyhydric aliphatic alcohols with olefin substituted succinic acid, and Mannich bases from high molecular weight alkylated phenols.

The high molecular weight polymeric ashless dispersants have the general formula:

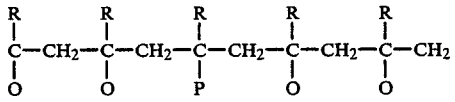

where
O = Oleophilic Group
P = Polar Group
R = Hydrogen or Alkyl Group

The function of an oxidation inhibitor is the prevention of a deterioration associated with oxygen attack on the lubricant base fluid. These inhibitors function either to destroy free radicals (chain breaking) or to interact with peroxides which are involved in the oxidation mechanism. Among the widely used anti-oxidants are the phenolic types (chain-breaking) e.g., 2,6-di-tert.-butyl para cresol and 4,4' methylenebis(2,6-di-tert.-butylphenol), and the zinc dithiophosphates (peroxide-destroying).

Wear is loss of metal with subsequent change in clearance between surfaces moving relative to each other. If continued, it will result in engine or gear malfunction. Among the principal factors causing wear are metal-to-metal contanct, presence of abrasive particulate matter, and attack of corrosive acids.

Metal-to-metal contact be prevented by the addition of film-forming compounds which protect the surface either by physical absorption or by chemical reaction. The zinc dithiophosphates are widely used for this purpose. These compounds were described under anti-oxidant and anti-bearing corrosion additives. Other effective additives contain phosphorus, sulfur or combinations of these elements.

Abrasive wear can be prevented by effective removal of particulate matter by filtration while corrosive wear from acidic materials can be controlled by the use of alkaline additives such as basic phenates and sulfonates:

Although conventional viscosity improvers are often used in "additive packages" their use should not be necessary for the practice of this invention since our particular blends of high and low molecular weight base lubricants produce the same effect. However, we do not want to exclude the possibility of adding some amounts of conventional viscosity improvers. These materials are usully oil-soluble organic polymers with molecular weights ranging from approximately 10,000 to 1,000,000. The polymer molecule in solution is swollen by the lubricant. The volume of this swollen entity determines the degree to which the polymer increases its viscosity.

Pour point depressants prevent the congelation of the oil at low temperatures. This phenomenon is associated with the crystallization of waxes from the lubricants. Chemical structures of representative commercial pour point depressants are:

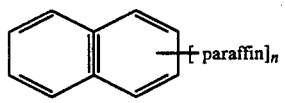

Alkylated Wax Naphthelene

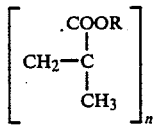

Polymethacrylates

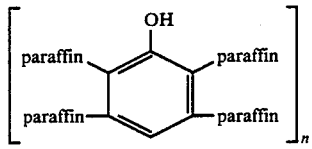

Alkylated Wax Phenol

Chemicals employed as rust inhibitors include sulfonates, alkenyl succinic acids, substituted imidazolines, amines, and amine phosphates.

The anti-foam agents include the silicones and miscellaneous organic copolymers.

Additive packages known to perform adequately for their recommended purpose are prepared and supplied by several major manufacturers. The percentage and type of additive to be used in each application is recommended by the suppliers. Typically available packages are:

1. HITEC E-320, supplied by Edwin Cooper Corp. for use in automotive gear oils,
2. Lubrizol 5002 supplied by the Lubrizol Corp. for use in industrial gear oils,
3. Lubrizol 4856 supplied by the Lubrizol Corp. for use in gasoline crankcase oil, and
4. OLOA 8717 supplied by Oronite Division of Chevron for use in diesel crankcase oils.

A typical additive package for an automotive gear lubricant would normally contain antioxidant, corrosion inhibitor, anti-wear agents, anti-rust agents, extreme pressure agent and foam inhibitor.

A typical additive package for a crankcase lubricant would normally be comprised of a dispersant, antioxidant, corrosion inhibitor, anti-wear agent, anti-rust agent and foam inhibitor.

An additive package useful for formulating a compressor fluid would typically contain an anti-oxidant, anti-wear agent, an anti-rust agent and foam inhibitor.

This invention describes blends of high viscosity synthetic hydrocarbons, having a viscosity range of 40 to 1000 cSt. with one or more synthetic hydrocarbon fluids having viscosities in the range of 1 to 10 cSt. and/or one or more compatible ester fluids having a viscosity range of 1 to 10 cSt. Such blends, when treated with a properly chosen additive "package" can be formulated in multi-graded crankcase or gear oils having superior shear stability, superior oxidative stability, and Newtonian viscometric properties. The blends of this invention also find uses in certain applications where no additive need be employed.

In discussing the constitution of the base oil blend, it is convenient to normalize the percentages of high viscosity synthetic hydrocarbons, low viscosity synthetic hydrocarbons, and low viscosity esters in the final lubricant so that they total 100%. The actual percentages used in the final formulation would then be decreased depending on the amount of additive packages utilized.

Each of the ingredients, high viscosity synthetic hydrocarbons, low viscosity synthetic hydrocarbons, and low viscosity esters are an important part of this invention. The high viscosity synthetic hydrocarbon provides thickening and VI improvement to the base oil blend. In addition, we have discovered that blends of high viscosity synthetic hydrocarbons with low viscosity synthetic hydrocarbons produce fluids having much greater oxidative stability than low viscosity synthetic hydrocarbons alone. This is illustrated in Example 7. The VI improvement produced by high viscosity synthetic hydrocarbon in blends with low viscosity synthetic hydrocarbons or low viscosity esters is shown in Examples 8 and 9. These improvements persist in blends of high viscosity synthetic hydrocarbons, low viscosity synthetic hydrocarbons, and low viscosity esters.

The low viscosity synthetic hydrocarbon fluid is frequently the main ingredient in the base oil blend, particularly in finished lubricants having an SAE viscosity grade of 30 or 40. While certain low viscosity esters are insoluble in high viscosity synthetic hydrocarbons, the presence of low viscosity synthetic hydrocarbon, being a better solvent for low viscosity esters, permits greater variations in the type of esters used in base oil blends of high viscosity synthetic hydrocarbons, low viscosity synthetic hydrocarbons, and low viscosity esters.

Crankcase and gear oils consisting solely of hydrogenated polyisoprene oligomers and low viscosity synthetic hydrocarbons with the proper additives produce synthetic fluids having excellent oxidative and hydrolytic stability. Such fluids are exemplified in Examples 22 and 23.

The third optional component, low viscosity esters can be used in combination with hydrogenated polyisoprene oligomers and low viscosity hydrocarbons or alone with hydrogenated polyisoprene oligomers. In the three component blend the proper choice of ester and hydrogenated polyisoprene oligomers can produce crankcase and gear oil formulations having outstanding viscosity indices and low temperature properties. Such three component blends are illustrated in Examples 24 and 25.

Two component blends of hydrogenated polyisoprene oligomers and esters can be used to prepare multigraded lubricants having outstanding viscometric properties, detergency, and oxidative stability. While some applications present environments having high moisture levels, which would be deleterious to certain esters, there are other applications such as automotive gear oils where the high ester contents found in the hydrogenated polyisoprene oligomers-ester blends can be used to advantage. Examples 26 and 27 illustrate the formulation of multigrade lubricants with such two component blends.

When it is deemed advantageous to use a low viscosity ester as part of the blend, the low viscosity hydrocarbons act as a common solvent for the ethylene-alpha-olefin oligomers and the added ester. Depending on the polarity of the ester, the latter two are frequently somewhat incompatible. Excellent multigraded lubricants can be formulated with or without ester.

The third component, low viscosity esters, can be added to produce the superior lubricants of this invention. High viscosity synthetic hydrocarbons and low viscosity synthetic hydrocarbons can be used alone to produce multigraded lubricants. The addition of low levels of low viscosity esters, usually 1–25% results in a base oil blend superior to blends of high viscosity synthetic hydrocarbons and low viscosity synthetic hydrocarbons alone in low temperature fluidity.

While low viscosity esters usually constitute 10–25% of the synthetic base oil blend, more or less can be used in specific formulations. When the final application involves exposure to moisture elimination or limitation of the amount of ester in blends may be advantageous.

The components of the finished lubricants of this invention can be admixed in any convenient manner or sequence.

An important aspect of the present invention is in the use of the properly constituted base oil blend in combination with the proper compatible additive package to produce finished multigrade lubricants having:

1. Permanent and temporary shear stability.
2. Excellent oxidation stability.
3. High viscosity index resulting in multigraded, non-"polymeric" lubricants.

The range of percentages for each of the components, i.e., high viscosity synthetic hydrocarbons, low viscosity synthetic hydrocarbons, low viscosity esters, and additive packages, will vary widely depending on the end use for the formulated lubricant, but the benefits of the compositions of this invention accrue when:

From 1 to 99% high viscosity synthetic hydrocarbons, from 0 to 99% low viscosity synthetic hydrocarbons, and from 0 to 99% low viscosity esters. It is preferred to blend from 10 to 80% high viscosity hydrocarbons with correspondingly 90 to 20% of at least one low viscosity ester base fluid or hydrocarbon base fluid. The fourth ingredient, the additive package, can be used in from 0 to 25% of the total formulation.

The lubricants of this invention, when properly formulated, display viscometrics of Newtonian fluids. That is, their viscosities are unchanged over a wide range of shear rates. While some of the high viscosity synthetic hydrocarbons of the invention may, in themselves, display non-Newtonian characteristics, particularly at low temperatures, the final lubricant products utilizing low viscosity oils as diluents are Newtonian. We have observed that synthetic hydrocarbons of up to 300 cSt. are Newtonian at room temperature as shown by the absence of a Weissenberg effect. And while fluids of 500 to 1000 cSt. do show a Weissenberg effect, solutions of such oligomers in quantities commonly used to attain Standard SAE viscosity grades do not.

The non-Newtonian character of currently used VI improvers is well documented. An excellent discussion can be found in an SAE publication entitled, "The Relationship Between Engine Oil Viscosity and Engine Performance—Part III." The papers in this publication were presented at a 1978 SAE Congress and Exposition in Detroit on Feb. 27 to Mar. 3, 1978.

The reference of interest is Paper 780374:

"Temporary Viscosity Loss and its Relationship to Journal Bearing Performance," M. L. McMillan and C. K. Murphy, General Motors Research Labs.

This reference, and many others familiar to researchers in the field, illustrates how commercial polymeric VI improvers of molecular weights from 30,000 and up all show a temporary viscosity loss when subjected to shear rates of $10^5$ to $10^6$ $sec^{-1}$. The temporary shear loss is greater for any shear rate with higher molecular weight polymers. For instance, oils thickened to the same viscosity with polymethacrylates of 32,000; 157,000; and 275,000 molecular weight show percentage losses in viscosity at a $5\times10^5$ $sec^{-1}$ shear rate of 10, 22 and 32%, respectively.

The thickening fluids of high viscosity synthetic hydrocarbons of this invention all have molecular weights below 5000, and so, it should be obvious that shear thinning of their solutions would be nil. That is, they will display Newtonian character.

The shear rates developed in pistons and gears (equal to or greater than $10^6$ $sec^{-1}$) is such that, depending on the polymeric thickener used, the apparent viscosity of the oils approaches that of the unthickened base fluids resulting in loss of hydrodynamic films. Since wear protection of moving parts has been correlated with oil viscosity, it is apparent that the wear characteristics of a lubricant can be downgraded as a result of temporary shear. The Newtonian fluids of the current invention maintain their viscosity under these use conditions and therefore afford more protection to and hence longer lifetime for the machinery being lubricated.

The currently used polymeric thickeners which show temporary (recoverable) shear are also subject to permanent shear. Extended use of polymeric thickeners leads to their mechanical breakdown with resultant loss in thickening power and decrease in VI. This is illustrated in Example 5. Paper 780372 (op. cit), "Polymer Stability in Engines" by W. Wunderlich and H. Jost discusses the relationship between polymer type and permanent shear. The multigrade lubricants of this invention are not as susceptible to even very severe mechanical shear.

This same paper also recognizes an often overlooked feature of high molecular weight polymeric VI improvers, i.e., their instability toward oxidation. Just as these polymers lose viscosity by shear they are also readily degraded by oxygen with the resultant breakdown of the polymer and decrease in viscosity index. The lubricating fluids of this invention suffer much less change in viscosity index upon oxidation.

Example 10 illustrates the oxidation of a low viscosity fluid thickened with 100 cSt. polyalphaolefin and compares it with the same fluid thickened with a commercial VI improver. Example II further compares the oxidative stability of fully formulated lubricants of this invention with two nearly identical lubricant formulations, except that the latter are thickened with commercial VI improver.

It is clear from the foregoing that lubricating oils of this invention are superor to traditional multi-graded lubricants because of their greater resistance to permanent shear and oxidation. The prolonged "stay in grade" performance of our lubricating fluids offers advances in durability of machinery using such fluids.

As mentioned earlier, the lack of temporary shear exhibited by the lubricants of this invention guarantees optimum viscosity for the protection of moving parts where high shear rates are encountered. The importance of this feature is widely recognized. In the past, SAE grinding (e.g. SAE 30) relied only on a measurement of the viscosity of a fluid at 100° C. under low shear conditions, despite the fact that in machinery such as a crankcase high temperatures and very high shear rates are encountered. This disparity has led to the adoption in Europe of a new grading system wherein viscosities for a certain grade are those measured at 150° C. and $10^6$ $sec^{-1}$ shear rate. This more realistic approach is currently being considered in the United States. The advantages a Newtonian fluid brings to such a grading system are obvious to anyone skilled in the art. The viscosity of a Newtonian fluid can be directly extrapolated to 150° C. under high shear conditions. A polymer thickened fluid, however, will invariably have a viscosity lower than the extrapolated value, frequently close to the base fluid itself. In order to attain a certain grade under high shear conditions, polymer thickened oils will require a more viscous base fluid. The use of thicker base fluids will produce higher viscosities at low temperature making it more difficult to meet the low temperature (5W for crakcase of 75W for gear oil) requirements for broadly multigraded oils.

Stated another way, current high molecular weight VI improvers "artificially" improve the viscosity index, since realistic high temperature high shear measurements are not utilized in determining VI. Viscosity index is determined by low shear viscosity measurements at 40° C. and 100° C. The Newtonian lubricants of this invention not only produce high viscosity index multigraded fluids which stay "in grade", but the VI and multigrade rating are realistic since they are not sensitive to shear.

While the specific compositions exemplified in this patent are fairly precise, it should be obvious to anyone skilled in the art to produce even further combinations within the scope of this invention which will be valuable lubricants.

The following examples illustrate some of the blends encompassed by our invention:

EXAMPLE 1

This example illustrates the preparation of multigraded gear oils utilizing high viscosity polyalphaolefin (PAO) as a thickener. For a 75W-140 gear oil the oil must have a minimum viscosity @ 100° C. of 24 cSt. and a viscosity of 150,000 cps or less at −40° C.

A. 75W-140 VISCOSITY GRADE

| MATERIAL | WT % A | B | C | D | E | F | G |
|---|---|---|---|---|---|---|---|
| PAO-100* | 60 | 57 | 58 | 57.5 | 51 | 57.5 | 57 |
| PAO-4** | | 13 | 12 | 12.5 | 25 | 22.5 | 13 |
| PAO-2*** | 16 | | | | | | |
| Di-isodecyl adipate | 16 | | | | | 10 | |
| Di-2-ethylhexyl dodecanoate | | | | 20 | | | |
| Di-2-ethylhexyl azelate | | 20 | | | 10 | | 20 |
| Hitec E-320[1] | 8 | | | | | | |
| Hitec E-324[1] | | | | | | | 10 |
| Anglamol 6043[2] | | 10 | 10 | 10 | | 10 | |
| OLOA 9150[3] | | | | | 14 | | |
| $KV_{100}$, cSt | 24.3 | 24.6 | 24.2 | 24.4 | 24.2 | 24.5 | 24.3 |
| VI | 170 | 168 | 169 | 166 | 167 | 174 | 167 |
| −40° C. vis, cP | 126,000 | 121,000 | 124,900 | 125,100 | 138,400 | 145,600 | 141,600 |

*100 cSt. hydrogenated polydecene
**4 cSt. hydrogenated polydecene
***2 cSt. hydrogenated polydecene
[1]Additive packages made by Edwin Cooper Co.
[2]Additive packages made by Lubrizol
[3]Additive packages made by Oronite B. 75W-90 VISCOSITY GRADE
For a 75W-90 oil the oil must have a minimum viscosity at 100° C. of 13.5 cSt. and a viscosity of 150,000 cP. or less at −40° C.

| MATERIAL | WT % A | B | C | D | E | F | G |
|---|---|---|---|---|---|---|---|
| PAO-100 | | 48.5 | 45 | 41.5 | 41.0 | 43.0 | 39 |
| PAO-40 | 66 | | | | | | |
| PAO-4 | 4 | 21.5 | 25 | 28.5 | 27.0 | 27.0 | 31 |
| Diisodecyladipate | 20 | 20 | 20 | | | 20 | |
| Di-2-ethylhexyl azelate | | | | 20 | 19.5 | | |
| Di-2-ethylhexyl didodecanoate | | | | | | | 20 |
| Hitec E-320[1] | 10 | 10 | 10 | | | | |
| Anglamol 6043[2] | | | | 10 | | 10 | 10 |
| Elco 7[3] | | | | | 12.5 | | |
| $KV_{100}$, cSt | 18.6 | 20.3 | 18.4 | 14.1 | 15.3 | 15.4 | 13.9 |
| VI | 149 | 166 | 169 | 171 | 172 | 177 | 170 |
| −40° C. vis, cP | 141,200 | 106,900 | 78,800 | 38,050 | 50,400 | 49,150 | 32,100 |

[1]Additive package made by Edwin Cooper Co.
[2]Additive package made by Lubrizol Corporation
[3]Additive package made by Elco Corporation C. 80W-140 VISCOSITY GRADE
For a 80W-140 oil the oil must have a minimum viscosity at 100° C. of 24 cSt. and a viscosity of 150,000 cP. or less at −26° C.

| MATERIAL | WT % A | B | C | D | E | |
|---|---|---|---|---|---|---|
| PAO-100 | 56 | | 55 | 58 | 60 | 52 |
| PAO-60 | | 67.6 | | | | |
| PAO-4 | 14 | | 15 | | | 18 |
| PAO-2 | | 4.4 | | 12 | 10 | |
| Diisodecyl adipate | 20 | 20 | | 20 | 20 | |
| Diisooctyl adipate | | | | | | |
| Di-2-ethylhexyl azelate | | | 20 | | | |
| Diisodecyl azelate | | | | | | 20 |
| Hitec E-320[1] | 10 | 8 | | | | |
| Ang. 99[2] | | | 10 | | | |
| Ang. 6004A[2] | | | | 10 | | |
| Ang. 6043[2] | | | | | 10 | 10 |
| $KV_{100}$, cSt | 26.0 | 25.2 | 24.2 | 24.8 | 24.6 | 24.7 |
| VI | 167 | 159 | 167 | 170 | 169 | 161 |
| −26° C. vis, cP | 65,400 | 82,740 | 60,200 | 52,650 | 61,440 | 63,610 |

[1]Additive package made by Edwin Cooper Co.
[2]Additive packages (Anglamol) made by Lubrizol

EXAMPLE 2

This example illustrates the preparation of an ISO VG 460 industrial gear lube which requires a viscosity at 40° C. between 414 and 506 cSt.

| Ingredient | Wt. % |
|---|---|
| PAO-100 | 77 |
| PAO-4 | 10 |
| Diisodecyl adipate | 10 |

-continued

| Ingredient | Wt. % |
|---|---|
| OS49241H* | 3 |

*additive package from Lubrizol

It had the following viscometrics

| | |
|---|---|
| $KV_{100}$ | 44.8 cSt |
| $KV_{40}$ | 414.3 |
| VI | 165 |
| VIS @ 26° C. | 78,600 cP. |

EXAMPLE 3

This example illustrates preparation of gasoline and diesel crankcase lubricants.

| | WT % | | | | | | | |
|---|---|---|---|---|---|---|---|---|
| MATERIAL | A | B | C | D | E | F | G | H |
| PAO-100 | 20 | 28 | 28 | 28 | 32 | 25 | 20 | 18 |
| PAO-4 | 42 | 47 | 34.5 | 34.5 | 47 | 37.5 | 42 | 54 |
| Di-2-ethylhexyl azelate | 20 | 10 | 20 | | 10 | | 20 | 10 |
| Hatcol 2934[1] | | | | 20 | | | | |
| Hercolube 401[2] | | | | | | 20 | | |
| OLOA 8717[3] | 18 | | | | | | | |
| OS61421[4] | | 15 | | | | | | |
| OS61906[4] | | | 17.5 | 17.5 | | 17.5 | | |
| LZ 4856[4] | | | | | 11 | | | |
| LZ 3940[4] | | | | | | | 18 | |
| OLOA 8716[3] | | | | | | | | 18 |
| $KV_{100}$, cSt | 10.2 | 13.2 | 13.2 | 13.2 | 13.6 | 13.2 | 9.9 | 10.0 |
| VI | 163 | 159 | 160 | 156 | 159 | 153 | 162 | 156 |
| vis grade | 5W-30 | 10W-40 | 10W-40 | 15W-40 | 10W-40 | 15W-40 | 5W-30 | 5W-30 |

[1]Available from Hatco division of Grace Co.
[2]Available from Hercules, Inc.
[3]Additive packages made by Oronite.
[4]Additive packages made by Lubrizol.

EXAMPLE 4

This example illustrates the excellent oxidative stability of gear oils utilizing high molecular weight PAO.

A 75W-90 gear oil prepared as in Example I.B.D. was subjected to the CRC L-60 Thermal Oxidation Stability Test. In this test 120 ml of oil are heated to 325°±1° F. and 11.1 liters/hour of air are passed through the fluid. The surface of the fluid is agitated by a gear running at 2540 Rpm. A 4 sq. in. copper catalyst is immersed in the fluid. After 50 hours, viscosity change, acid no., benzene and pentane insolubles are determined. The results for this fluid are:

| | |
|---|---|
| change in $KV_{100}$ | 12.0% |
| Acid No. | 3.18 |
| pentane insolubles, wt % | 0.34 |
| benzene insolubles, wt % | 0.25 |
| Military requirements are | change in $KV_{100}$ less that 100%, pentane insolubles less than 3%, & benzene insolubles less than 2% |

EXAMPLE 5

This example illustrates the resistance to mechanical shear of gear lubricants thickened with high viscosity PAO.

A. A 75W-140 gear oil as prepared in Example 1.A.B. was subjected to the Cannon Shear Test. In this test the fluid is subjected to preloaded tapered roller bearings running at 3450 r.p.m. After 8 hrs. under these conditions this fluid lost less than 0.4% of its viscosity.

| | |
|---|---|
| $KV_{100}$, initial | −24.93 cSt. |
| $KV_{100}$, final | −24.84 cSt. |

B. A 75W-140 gear oil as prepared in Example 1.A.B. was used to fill the drive axle of a Class 8 line haul truck. After 30,000 road miles the viscosity was essentially unchanged.

| | |
|---|---|
| $KV_{100}$, initial | −24.88 cSt. |
| $KV_{100}$, 30,000 mi. | −24.84 cSt. |

EXAMPLE 6

This example illustrates the Newtonian character of gear lubricants and engine lubricants thickened with PAO-100.

A. A gear lubricant as prepared in Example 1.B.D. had its viscosity measured at 100° C. under no shear conditions (ASTM D-445). The same sample's viscosity was determined at 100° C. under a shear rate of $10^6$ $sec^{-1}$ in a Tapered Bearing Simulator and was essentially unchanged.

B. A crankcase lubricant as prepared in Example 3.E had its viscosity measured at 150° C. under no shear conditions (ASTM D-445). The same sample's viscosity was determined at 150° C. under a shear rate of $10^6$ $sec^{-1}$ in a Tapered Bearing Simulator and was essentially unchanged.

EXAMPLE 7

This example illustrates the oxidative stability of blends of 100 cSt. PAO and low viscosity PAO. The low viscosity fluids were 4 and 6 cSt. polydecenes. The blends were stabilized with 0.75 parts per 100 of oil (PHO) of p-nonylphenyl alphanaphthylamine and 0.25 PHO of dilaurylthiodiproprionate. They were subjected to a 370° F. temperature for 72 hours while air was passed through the solutions at a rate of 5 liters per hour. The oxidation was performed in the presence of Mg, Fe, Cu, Al and Ag metal specimens. At the end of the test period, the solutions were filtered and the amount of hexane insoluble sludge formed (expressed as mg. per 100 ml.) was determined for each. The results are summarized in the following table.

| PAO | 4 | 6 | 100 | Sludge (mg/100 ml) Observed | Predicted | % Reduction |
|---|---|---|---|---|---|---|
| % | 100 | — | — | 676 | | |
| % | — | 100 | — | 322 | | |
| % | — | — | 100 | 2 | | |
| % | 75 | — | 25 | 42 | 507 | −92% |
| % | — | 75 | 25 | 23 | 242 | −90% |
| % | — | 25 | 75 | 2 | 81 | −98% |

Even though low viscosity PAO's are noted for their stability, it is evident that the blends with high viscosity PAO are more stable than would be predicted by simple additivity. In the above example, the addition of 25% PAO-100 to 4 or 6 cSt. PAO gave blends which produced only 10% of the sludge expected from oxidation. The mechanism by which the high viscosity hydrogenated PAO's of this invention "protect" lower viscosity fluids, as seen in this example, is not understood.

EXAMPLE 8

This example illustrates the viscosity index improvement achieved by blending the high viscosity synthetic hydrocarbons (represented by 100 cSt. PAO) and low viscosity synthetic hydrocarbons (represented by 4 and 6 cSt. polydecene) of this invention.

| PAO viscosity (100° C.) | 2 | 4 | 6 | 100 | $KV_{100}$ | VI | Change in VI |
|---|---|---|---|---|---|---|---|
| % in Blend | 100 | — | — | — | 1.89 | — | — |
| | 90 | — | — | 10 | 2.50 | 136 | — |
| | 75 | — | — | 25 | 4.54 | 186 | — |
| | 50 | — | — | 50 | 12.07 | 187 | — |
| % in Blend | — | 100 | — | — | 3.99 | 119 | — |
| | — | 90 | — | 10 | 5.60 | 150 | +26 |
| | — | 75 | — | 25 | 9.10 | 162 | +32 |
| % in Blend | — | — | 100 | — | 6.05 | 132 | — |
| | — | — | 90 | 10 | 8.15 | 146 | +11 |
| | — | — | 75 | 25 | 12.61 | 152 | +12 |
| | — | — | — | 100 | 101 | 165 | — |

The viscosity indices obtained by blending low and high viscosity produce a much higher V.I. than predicted by straight extrapolation. The change in VI in the above chart is a measure of the enhancement of VI over that expected by simple additivity.

In essence the table illustrates the preparation of hydrocarbon base fluids having V.I.'s higher than any commercially available PAO's in the viscosity range 2–15 cSt. It is this unexpectedly large enhancement of VI which permits the blending of Newtonian multigraded lubricants. This effect is further illustrated in Example (9).

This Example (8) also illustrates the feature that V.I. enhancement is the greatest when the viscosities of the blend components are farthest apart.

EXAMPLE 9

This example is similar to Example 8, but illustrates V.I. enhancement achieved by blending high viscosity PAO (100 cSt.) with each of two different esters.

| Ingredient | Diisooctyl Adipate | Ditridecyl Azelate | PAO-100 | $KV_{100°C.}$ | VI | Change in V.I. |
|---|---|---|---|---|---|---|
| % | 100 | — | — | 3.63 | 141 | — |
| | 90 | — | 10 | 5.05 | 171 | +28 |
| | 75 | — | 25 | 8.30 | 182 | +35 |
| % | — | 100 | — | 2.96 | 139 | — |
| | — | 90 | 10 | 4.25 | 179 | +34 |
| | — | 75 | 25 | 7.21 | 191 | +46 |

These data illustrate the V.I. enhancement shown in Example 8 is valid in ester blends also. The higher V.I.'s of the pure esters contribute to the remarkably high V.I.'s obtained with ester-PAO blends. The high V.I.'s of such blends are manifested in the final lubricants of this invention (as shown in Example 1) and result in extremely good viscosity properties at low temperatures.

EXAMPLE 10

This example compares directly the oxidative stability of a base fluid thickened with a commercial V.I. improver (ECS 7480 from Paramin's Division of Exxon) to that of the same base fluid thickend with a high viscosity synthetic hydrocarbon (100 cSt. PAO). The base fluid chosen as the medium to be thickened was a polydecene having $KV_{210°F.}$ of 5.96 cSt. and a V.I. of 136. The solutions were stabilized with 0.5 PHO of phenyl alphanaphthyl amine and 0.25 PHO of dilauryl thiodipropionate. The oxidation test was performed as described in Example 7. A comparison of the solutions before and after testing is summarized in the following table.

| Fluid Composition, Wt % | $KV_{210}$ | V.I. |
|---|---|---|
| A. 6 cSt. PAO - 90 | | |
| ECA 7480 - 10 | | |
| Before Test | 9.61 | 165 |
| After Test | 6.64 | 134 |
| B. 6 cSt. PAO - 90 | | |
| 100 cSt. PAO - 10 | | |
| Before Test | 7.94 | 149 |
| After Test | 8.21 | 147 |
| C. 6 cSt. PAO - 75 | | |
| 100 cSt. PAO - 25 | | |
| Before Test | 12.34 | 153 |
| After Test | 12.78 | 151 |

As can be seen, in composition A. the polymeric thickener decomposed drastically. The viscosity after testing was nearly equivalent to that of the starting base fluid. The viscosity index of composition A decreased to that of the base fluid, illustrating that oxidation, as well as shear, destroys the V.I. improvement gained by the use of high molecular weight polymeric additives.

Compositions B. and C., on the other hand, experienced minimal change in viscosity and viscosity index, illustrating the oxidative stability of blends of the high and low viscosity synthetic hydrocarbon of this invention.

EXAMPLE 11

This example illustrates the fomulation of finished crankcase lubricants of the invention and compares their oxidative stability with nearly identical formulations utilizing commercial high molecular weight polymeric thickeners. The fluids were oxidized under the same conditions as were described in Example 10.

| COMPOSITION | 11-A | 11-B | 11-C | 11-D | 11-E |
|---|---|---|---|---|---|
| Wt. % A | 32 | | | | |
| Wt. % B | | 19 | | | |
| Wt. % C | | | 20.5 | | |
| Wt. % D | | | | 17 | |
| Wt. % E | | | | | 12.25 |
| Wt. % F | 47 | 60 | 58.5 | 62 | 66.75 |
| Wt. % G | 10 | 10 | 10 | 10 | 10 |
| Wt. % H | 11 | 11 | 11 | 11 | 11 |
| I (PHO) | 0.5 | 0.5 | 0.5 | 0.5 | 0.5 |

Ingredients A, B and C represent the thickeners of this invention. Ingredients D and E represent commercial high molecular weight V.I. improvers.

A is a 100 cSt. hydrogenated polydecene.

B is a 265 cSt. liquid ethylene-propylene oligomer having 49 weight % propylene.

C is a 245 cSt. hydrogenated polyisoprene oligomer.

D is Lubrizol 7010, a commercially available high molecular weight olefin copolymer (OCP) V.I. improver.

E is Acryloid 954, a high molecular weight polymethacrylate sold by Rohm and Haas.

F is 4 cSt. polydecene sold by Gulf Oil Co.

G is Emery 2958, di-2-Ethylhexyl azelate.

H is Lubrizol 4856, a CD-SF crankcase package sold by Lubrizol Corp.

I is LO-6, an alkylated phenyl alphanaphthylamine from Ciba-Geigy.

The viscometric properties of fluids 11-A, 11-B, 11-C, 11-D and 11-E are compared in the following table before and after subjection to oxidation at 370° F. as described in Example 10.

| | UNAGED LUBRICANTS | | | AGED LUBRICANTS | | | % Change |
|---|---|---|---|---|---|---|---|
| | $KV_{100°C.}$ | $KV_{40°C.}$ | V.I. | $KV_{100°C.}$ | $KV_{40°C.}$ | V.I. | V.I. |
| 11-A | 12.83 | 79.28 | 162 | 14.63 | 93.17 | 164 | +1% |
| 11-B | 12.83 | 75.27 | 172 | 14.61 | 91.55 | 166 | −3.5% |
| 11-C | 12.55 | 76.07 | 164 | 14.32 | 94.87 | 156 | −5% |
| 11-D | 12.70 | 68.50 | 188 | 10.93 | 68.60 | 150 | −20 |
| 11-E | 14.81 | 68.14 | 230 | 22.00 | 130.98 | 196 | −15% |

The fluids of this invention (11-A, 11-B and 11-C) can be seen to be far more stable to oxidation than nearly identical fluids prepared using commercial V.I. improvers. The inherent instability of 11-D and 11-E is evidenced by the large changes in viscosity and large decrease in viscosity index suffered by these fluids.

EXAMPLE 12

The example compares the oxidative stability of a low viscosity fluid thickened with a variety of ethylene-propylene polymers, each having a different viscosity and molecular weight. The low viscosity fluid chosen was a commercial polydecene oligomer having a kinematic viscosity at 100° C. ($K.V._{100}$) of 3.83 cSt. One hundred ml. of each fluid was heated to 370° F. for 72 hours. Air was bubbled through the samples at a rate of 5 liters per hours. Metal washers (Mg, Fe, Ag, Cu, and Al), each having a surface area of 5 $cm^2$, were suspended in the fluids as oxidation catalysts and as specimens to determine corrosivity of the oxidized fluids (by weight change). Each sample was protected with exactly the same proprietary antioxidant. Separate studies have shown that the polydecene base fluid is extremely well protected by the antioxidant used. After oxidation, the amount of particulates (sludge) formed was weighed, the acid number of the oils was measured, the viscosity changes of the samples were determined and any weight changes in the metal specimens were measured. A zero change in all these parameters indicates no oxidative degradation. The following tables outline the oils tested and the results of the oxidation test.

TABLE IA

| | Properties of Unaged Blends | | | | |
|---|---|---|---|---|---|
| Thickener | wt % | PAO-"4" wt % | $K.V._{100}$ | $K.V._{40}$ | V.I. |
| — | 0 | 100 | 3.83 | 16.90 | 119 |
| A | 57 | 43 | 25.42 | 199.60 | 160 |
| B | 49 | 51 | 32.55 | 240.20 | 180 |
| C | 40 | 60 | 32.33 | 242.74 | 177 |
| D | 31 | 69 | 24.25 | 145.20 | 200 |

Where:

A is a liquid ethylene-propylene copolymer having a viscosity of 92 cSt. at 100° C.

B is a liquid ethylene-propylene copolymer having a viscosity of 190 cSt. at 100° C.

C is a liquid ethylene-propylene copolymer having a viscosity of 409 cSt. at 100° C.

D is a commercially available viscosity index improver consisting of a solution of high molecular weight ethylenepropylene copolymer rubber dissolved in a low viscosity mineral oil. The contained rubber in such thickeners is usually 5 to 10 weight %.

The following table illustrates the viscometric changes which occurred to the above blends after the described oxidation.

TABLE IB

Properties of Aged Blends

| | Aged | | | % after aging | | |
|---|---|---|---|---|---|---|
| Thickener | $K.V._{100}$ | $K.V._{40}$ | VI | $K.V._{100}$ | $K.V._{40}$ | VI |
| NONE | 3.92 | 17.61 | 118 | +2.3 | +4.1 | −0.8 |
| A | 24.32 | 189.7 | 158 | −4.3 | −5.0 | −1.3 |
| B | 28.46 | 207.3 | 176 | −12.6 | −13.7 | −2.2 |
| C | 28.53 | 201.8 | 181 | −11.8 | −16.9 | +2.3 |
| D | 8.51 | 41.51 | 188 | −64.9 | −71.4 | −6.0 |

Clearly, the thickeners of this invention (A, B and C) are much more stable to viscosity and viscosity index losses from oxidation than the current commercial thickener (D). The viscosity losses observed in this test increase as the molecular weight of the thickener increases and decrease when at a given molecular weight, the amount of thickener used decreases. Samples B and C illustrate this while C is a higher molecular weight thickener ($M_n$=1625), than B ($M_n$=1360), the fact that C is employed in a lower amount to produce the same viscosity in the blend counterbalances its inherently greater tendency to lose viscosity and both B and C perform similarly in the test. Sample D, on the other hand, actually contains only about 2-3% high molecular weight thickener, but the molecular weight is so high relative to A, B and C that its degradation produces much more severe viscosity losses. At the other extreme, sample A is quite low molecular weight and so suffers very little change in viscosity despite the large amount of thickener used in its blend. Thus the fluids of this patent, having viscosities up to 1000 cSt. at 100° C. are shown to have outstanding resistance to oxidative breakdown when compared with currently available thickeners.

In addition to viscosity changes, the relative resistance toward oxidation of the blends is illustrated by the acid developed (measured by acid number) during aging, the particulates (sludge) formed during the test and by weight change of the metal specimens. The following table features data on these parameters:

TABLE IC

| Thickener | Aged Acid No. | Sludge mg/100 ml. | wt. change, $Mg_2$specimen $mg/cm^2$ |
|---|---|---|---|
| (none) | 0.20 | 2.0 | 0 |
| A | 2.7 | 5.3 | −0.18 |
| B | 4.4 | 0 | −0.02 |
| C | 6.7 | 0 | −0.02 |
| D | 8.6 | 2,200 | −1.88 |

Again the acid build up, metal attack and, especially, sludge production found in sample D only, dramatically demonstrate its inferiority to the examples (A, B and C) of our invention.

EXAMPLE 13

This example illustrates the thickening power and V.I., improvement of the oligomers of this invention.

One way of comparing thickening power is to ascertain the viscosity increase caused by the addition of a certain percentages of thickener to a common base stock. The base fluid used in this example was a polydecene of $K.V._{100}=3.83$. In all cases, 25 wt. % thickener was added, with the following results.

| Thickener | $K.V._{100}$ | $M_n$ | $K.V._{100}$ blend |
|---|---|---|---|
| A | 92 | 1090 | 9.12 |
| B | 190 | 1360 | 12.02 |
| C | 409 | 1650 | 16.32 |
| D | 830 | 1890 | 20.46 |
| E | — | — | 17.16 |

Thickeners A, B, C, and D are ethylene-propylene oligomers of this invention. Thickener E is Lubrizol 7010, a commercial "OCP" thickener consisting of an oil solution of a rubbery high molecular weight ethylene-propylene copolymer. The viscosity of Lubrizol 7010 is given as about 1000 cSt. at 100° C.

Clearly, at the higher viscosities encompassed by this invention (500–1000 cSt.), the described oligomers are equal to or even superior to commercial thickeners and as illustrated in Example I, all will have greater stability.

Another way of examining thickeners is to compare how much additive is required to increase the viscosity of a fluid to a given value. In the following table, the low viscosity polydecene was thickened to 13 cSt. and 24 cSt. with each of the thickeners listed above.

| Thickener | Amount required to thicken 3.83 cSt polydecene: (wt %) 13 cSt. | 24 cSt. |
|---|---|---|
| A | 36 | 55 |

-continued

| Thickener | Amount required to thicken 3.83 cSt polydecene: (wt %) 13 cSt. | 24 cSt. |
|---|---|---|
| B | 26.5 | 40.5 |
| C | 22 | 34.2 |
| D | 17.5 | 28 |
| E | 20.5 | 31 |

Once again fluids of this invention can be so chosen as to require smaller amounts to thicken low viscosity fluids to a given higher viscosity (D vs. E). While thickeners A, B and C require higher treat levels than E, they are surprisingly efficient thickeners for their viscosity and as stated earlier produce a more stable blend.

The following data illustrate the V.I. improvement properties of the oligomers of this invention in the preparation of 24 cSt. fluids useful as base oils for the preparation of multigraded lubricants such as SAE 140 gear oils.

| Thickener | wt. % added to 3.83 cSt. Polydecene* | $K.V._{100}$ | V.I. |
|---|---|---|---|
| A | 55 | 24.12 | 162 |
| B | 40.5 | 24.07 | 180 |
| C | 34.2 | 24.31 | 180 |
| D | 28 | 24.24 | 184 |

*as described earlier in this example

As stated earlier in this patent a viscosity index of 149 is the minimum required for a 75W-140 multigrade gear oil Clearly all the fluids of this invention qualify easily in this regard. Later examples will show that the low temperature properties predicted for these fluids are actually attained.

EXAMPLE 14

This example describes the preparation of an SAE viscosity grade 10W-40 diesel crankcase oil using a liquid ethylene propylene oligomer having a kinematic viscosity at 100° C. of 432 cSt.

| Ingredient | wt % |
|---|---|
| Ethylene-propylene oligomer | 18 |
| PAO-4 | 70 |
| Lubrizol 4856 | 12 |

The lubricant has the following properties
$KV_{100}$-14.4 cSt.
$KV_{40}$-87.5 cSt.
V1-173
CCS@-20° C. 3215 cP

EXAMPLE 15

This example describes the preparation of an SAE viscosity grade 75W-140 automotive gear oil using a liquid ethylene propylene oligomer having a kinematic viscosity at 100° C. of 432 cSt.

| Ingredient | wt % |
|---|---|
| Ethylene-propylene liquid | 32 |
| PAO-4 | 58 |
| Anglamol 6043 | 10 |

The lubricant has the properties shown:

$KV_{100}$-24.3 cSt
$KV_{40}$-160.8 cSt
VI-184
Viscosity @−40° C.=97,650 cP

EXAMPLE 16

This example describes the preparation of an SAE viscosity grade 10W-40 diesel crankcase lubricant using an ethylene propylene oligomer having a kinematic viscosity at 100° C. of 945 cSt.

| Ingredient | wt % |
|---|---|
| Ethylene-propylene liquid | 12 |
| PAO-4 | 50 |
| Dialkyl benzene | 20 |
| Lubrizol 3940 | 18 |

The lubricant has the properties shown:
$KV_{100}$-13.2 cSt
$KV_{40}$-78.0 cSt
V1-172
CCS @−20° C.=3260 cP

EXAMPLE 17

This example illustrates the preparation of an automotive gear lubricant SAE viscosity grade 75W-140 using a liquid ethylenepropylene oligomer having a kinematic viscosity at 100° C. of 265 cSt.

| Ingredient | wt % |
|---|---|
| Ethylene-propylene liquid | 36 |
| PAO-4 | 34 |
| Di-2-ethyl hexyl azelate | 20 |
| Anglamol 6043 | 10 |

The lubricant has the properties shown:
$KV_{100}$-24.87 cSt
$KV_{40}$-161.1 cSt
V1-188
Brookfield vis @−40° C.=88,700 cP

EXAMPLE 18

This example illustrates the preparation of a diesel crankcase lubricant SAE viscosity grade 10W-40 using a liquid ethylene-propylene oligomer having a kinematic viscosity at 100° C. of 945 cSt.

| Ingredient | wt % |
|---|---|
| Ethylene-propylene liquid | 14 |
| PAO-4 | 48 |
| Di-2-ethyl hexyl azelate | 20 |
| Lubrizol 3940 | 18 |

The lubricant has the properties shown:
$KV_{100}$-13.4 cSt.
$KV_{40}$-80.4
V.I.-170
CCS @—20° C.=2920 cP.

EXAMPLE 19

This example illustrates the preparation of an ISO VG 460 industrial gear lubricant from an ethylene-propylene oligomer having a kinematic viscosity at 100° C. of 945 cSt.

| Ingredient | wt % |
|---|---|
| Ethylene-propylene liquid | 42 |
| PAO-4 | 45 |
| Diisodecyl adipate | 10 |
| Lubrizol 5034 | 3 |

The lubricant has the properties shown:
$KV_{100}$-59.5 cSt.
$KV_{40}$-462 cSt.
V1-202

EXAMPLE 19

This example compares the oxidative stability of fully formulated crankcase oils utilizing the hydrogenated polyisoprenes of this invention with essentially identical formulations thickened to the same viscosity with two commercially available high molecular weight ethylene-propylene rubber based thickners and a purchased sample of high quality crankcase oil. One hundred ml. of each fluid was heated to 370° F. for 72 hrs. Air was bubbled through the samples at a rate of 5 liters per hour. Metal washers (Mg, Fe, Cu and Al), each having a surface area of 5 $cm^2$, were suspended in the fluids as oxidation catalysts and as specimens to determine corrositivity of theoxidized fluids (by weight change). Each sample contained a low viscosity polydecene and equal amounts of ester and additive package. After oxidation, the changes in viscosity and viscosity index were determined as well as the weight changes in the metal specimens. The following tables outline the formulations and their unaged viscometrics as well as the changes wrought by oxidation. The low viscosity synthetic hydrocarbon (SHC) in the blends was a polydecene having a $K.V._{100° C.}$ of 3.83 cSt. The ester was di-2-Ethylhexyl azelate and the package was Lubrizol 4856.

TABLE 20A

| Properties of the Unaged Blends | | | | |
|---|---|---|---|---|
| Thickener | A | B | C | D |
| Wt. % Thickener | 20.5 | 17 | 15 | — |
| Wt. % SHC | 58.5 | 62 | 64 | — |
| Wt. % Ester | 10 | 10 | 10 | — |
| Wt. % Additive Package | 11 | 11 | 11 | — |
| $K.V._{100° C.}$ | 12.55 | 12.70 | 12.54 | 13.83 |
| $K.V._{40° C.}$ | 76.07 | 68.50 | 67.99 | 93.09 |
| V.I. | 164 | 188 | 186 | 151 |

A was a 245 cSt. hydrogenated polyisoprene.
B was a commercial thickener.
C was a different commercial thickener.
D was a premium motor oil.

After oxidation, the viscometric properties of the above fluids were as outlined in the following table.

TABLE 20B

| Sample | $K.V._{100}$ | % Change $K.V._{100}$ | $K.V._{40}$ | % Change $K.V._{40}$ | V.I. | %Change V.I. |
|---|---|---|---|---|---|---|
| A | 14.32 | +14.1 | 94.87 | +24.7 | 156 | −4.9 |
| B | 10.93 | −13.9 | 68.60 | +0.1 | 150 | −20.2 |
| C | 9.34 | −25.5 | 53.86 | −20.8 | 157 | −15.6 |
| D | 7.96 | −42.4 | 51.02 | −54.2 | 125 | −17.2 |

Clearly, the composition of the present invention (A), is superior in oxidative stability to prior art B, C and D. As can be seen, composition A suffered no loss in viscosity and minimal change in viscosity index. These features predict much greater "stay-in-grade" performance for the compositions of this invention.

While all samples produced minimal amounts of insoluble "sludge" (less than 100 parts per million), and no corrosion to Mg, Fe or Al; Composition A was found to produce less corrosion to Cu and Ag than the other compositions. The following table outlines the weight change observed (in mg/cm$^2$) in the Cu and Ag metal specimens for the tested formulations.

TABLE 20C

| Fluid | Change Cu, mg/cm$^2$ | Change Ag, mg/cm$^2$ |
|---|---|---|
| A | −3.46 | +0.10 |
| B | −8.52 | −1.30 |
| C | −7.88 | −2.10 |
| D | −13.82 | −4.62 |

These findings again indicate the greater stability of formulation A.

EXAMPLE 21

This example compares the thickening power of the hydrogenated polyisoprene oligomers of this invention with a commercial "OCP" thickener, Lubrizol 7010, which is a solution of high molecular weight ethylene-propylene rubber in oil. Solutions made by dissolving varying amounts of different thickeners in a low viscosity (3.83 cSt. at 100° C.) polydecene. The dependence of thickening power on viscosity of the thickener is clearly seen.

| Thickener | Wt. % Thickener | K.V.$_{100}$ Blend |
|---|---|---|
| A | 10 | 5.41 |
| | 25 | 9.47 |
| | 50 | 22.10 |
| B | 10 | 6.60 |
| | 25 | 13.72 |
| | 50 | 38.21 |
| C | 10 | 7.68 |
| | 25 | 18.31 |
| | 50 | 63.61 |
| D | 10 | 7.95 |
| | 25 | 22.11 |
| | 50 | 90.50 |

| Ingredient | Wt. % |
|---|---|
| HPO | 38 |
| PAO-4 | 52 |
| Anglamol 6043 | 10 |

The lubricant had the following properties:
KV$_{100}$-24.1 cSt.
KV$_{40}$-177.4 cSt.
V1-166
Vis. @−40° C.=142,100 cP.

EXAMPLE 23

This example illustrates the preparation of an SAE viscosity grade 10W-40 diesel crankcase lubricant from a hydrogenated polyisoprene with a kinematic viscosity of 245 cSt. at 100° C.

| Ingredient | Wt. % |
|---|---|
| HPO | 19 |
| PAO-4 | 63 |
| Lubrizol 3940 | 18 |

The lubricant had the following properties:
KV$_{100}$-14.4 cSt.
KV$_{40}$-95.9 cSt.
VI-155
CCS @−20° C.=3480 cP.

EXAMPLE 24

This example illustrates the preparation of SAE viscosity grade 10W-40 diesel crankcase oils using hydrogenated polyisoprene oligomers having the kinematic viscosities at 100° C. shown.

| Ingredient | Wt. % |
|---|---|
| a. HPO (KV$_{100}$-245) | 18 |
| PAO-4 | 44 |
| Di-2-Ethylhexyl azelate | 20 |
| Lubrizol 3940 | 18 |
| b. HPO (KV$_{100}$-546) | 14 |
| PAO-4 | 48 |
| Di-2-Ethylhexyl azelate | 20 |
| Lubrizol 3940 | 18 |
| c. HPO (KV$_{100}$-984) | 11 |
| PAO-4 | 51 |
| Di-2-Ethyhexyl azelate | 20 |
| Lubrizol 3940 | 18 |

The lubricants had the properties shown:

| | a | b | c |
|---|---|---|---|
| KV$_{100}$, cSt. | 13.2 | 13.2 | 13.3 |
| KV$_{40}$, cSt. | 81.0 | 79.5 | 78.3 |
| VI | 164 | 168 | 173 |
| CCS @ −20° C., cP. | 3250 | 2975 | 2780 |

EXAMPLE 25

This example illustrates the preparation of an SAE viscosity grade 75W-140 automotive gear lubricant using hydrogenated polyisoprene oligomers having the kinematic viscosities at 100° C. shown.

| Ingredient | Wt. % |
|---|---|
| a. HPO (KV$_{100}$-245) | 40 |
| PAO-4 | 30 |
| Di-2-ethyl hexyl azelate | 20 |
| Anglamol 6043 | 10 |
| b. HPO (KV$_{100}$-546) | 31 |
| PAO-4 | 39 |
| Di-2-ethyl hexyl azelate | 20 |
| Anglamol 6043 | 10 |
| c. HPO (KV$_{100}$-984) | 24 |
| PAO-4 | 46 |
| Di-2-ethyl hexyl azelate | 20 |
| Anglamol 6043 | 10 |

The lubricants had the properties shown:

| | a | b | c |
|---|---|---|---|
| KV$_{100}$, cSt. | 24.4 | 24.2 | 24.5 |
| KV$_{40}$, cSt. | 173.3 | 161.5 | 160.1 |
| VI | 172 | 182 | 196 |
| CCS @ −40° C., cP. | 132,000 | 94,300 | 78,600 |

EXAMPLE 26

This example describes the preparation of an SAE 10W-40 diesel crankcase lubricant using a hydrogenated polyisoprene oligomer having a kinematic viscosity of 245 cSt. at 100° C.

| Ingredient | Wt. % |
|---|---|
| HPO | 20 |
| *Polyol ester | 68 |
| Lubrizol 4856 | 12 |

*A mixed polyol from Humko (Kemester 1846).

The properties of the lubricant are shown:
$KV_{100}$-15.2 cSt.
$KV_{40}$-96.5 cSt.
VI-166
CCS @−20° C.=3460 cP.

EXAMPLE 27

This example illustrates the preparation of an SAL viscosity grade 75W-140 automotive gear oil using a hydrogenated polyisoprene oligomer having kinematic viscosity at 100° C. of 245 cSt.

| Ingredient | Wt. % |
|---|---|
| HPO | 42 |
| Di-2-Ethyl hexyl azelate | 48 |
| Lubrizol 4856 | 10 |

The lubricant has the following properties.
$KV_{100}$-24.4 cSt.
$KV_{40}$-167.3 cSt.
VI-178
Vis. @−40° C.=128,600 cP.

We claim:

1. A lubricating composition comprising:
(a) between 1 and 99 weight percent, based on the weight of components (a), (b) and (c), of a polyalphaolefin having a viscosity of between 40 and 1000 centistokes at 100° C.;
(b) between 0 and 99 weight percent, based on the weight of components (a), (b) and (c), of a synthetic hydrocarbon having a viscosity of between 1 and 10 centistokes at 100° C.;
(c) between 0 and 99 weight percent, based on the weight of components (a), (b) and (c), of a carboxylic acid ester having a viscosity of between 1 and 10 centistokes at 100° C.; and
(d) between 0 and 25 percent by weight of an additive package;

wherein at least 1 weight percent, based on the weight of components (a), (b) and (c), of component (b) and/or (c) is present.

2. The composition of claim 1 wherein component (a) has a viscosity of between 60 and 1000 centistokes at 100° C.

3. The composition of claim 1 wherein component (a) is a polymer of a member of the group of monomers consisting of octene-1, decene-1 and dodecene-1.

4. The composition of claim 3 wherein component (a) is poly(decene-1).

5. The composition of claim 1 wherein at least 1 weight percent, based on the weights of components (a), (b) and (c), of component (b) is present.

6. The composition of claim 1 wherein at least 1 weight percent, based on the weight of components (a), (b) and (c), of component (c) is present.

7. The composition of claim 1 wherein at least 1 weight percent, based on the weight of components (a), (b) and (c), of components (b) and (c) is present.

8. The composition of claim 7 wherein component (a) has a viscosity of between 60 and 1000 centistokes at 100° C.

9. The composition of claim 7 wherein component (a) is a polymer of a member of the group of monomers consisting of octene-1, decene-1 and dodecene-1.

10. The composition of claim 9 wherein component (a) is poly(decene-1).

* * * * *